US005908190A

United States Patent [19]

Tanaka

[11] Patent Number: 5,908,190

[45] Date of Patent: Jun. 1, 1999

[54] SHEET CONVEYING APPARATUS HAVING A GUIDE UNIT FOR GUIDING A SHEET WHEN DRAWING OUT A CONVEY UNIT

[75] Inventor: Makoto Tanaka, Abiko, Japan

[73] Assignee: Canon Kabushiki Kaisha, Tokyo, Japan

[21] Appl. No.: 08/614,550

[22] Filed: Mar. 13, 1996

[30] Foreign Application Priority Data

Mar. 17, 1995 [JP] Japan ..... 7-058903

[51] Int. Cl.[6] ..... B65H 5/00

[52] U.S. Cl. ..... 271/225; 271/272

[58] Field of Search ..... 271/3.03, 162, 271/164, 188, 250, 272, 273, 274, 225, 184

[56] References Cited

U.S. PATENT DOCUMENTS

| | | | |
|---|---|---|---|
| 4,958,823 | 9/1990 | Iwaki et al. | 271/9 |
| 5,280,898 | 1/1994 | Nakano et al. | 271/273 X |

FOREIGN PATENT DOCUMENTS

| | | | |
|---|---|---|---|
| 0621514A1 | 10/1994 | European Pat. Off. . | |
| 148137 | 9/1983 | Japan | 271/250 |
| 59-207333 | 11/1984 | Japan . | |
| 140424 | 6/1986 | Japan | 271/3.03 |
| 231752 | 9/1989 | Japan | 271/3.03 |
| 3-003828 | 1/1991 | Japan . | |
| 3-227885 | 10/1991 | Japan . | |
| 6-001471 | 1/1994 | Japan . | |

OTHER PUBLICATIONS

Patent Abstracts of Japan, vol. 15, No. 109 (M–1093), Mar. 15, 1991.

Patent Abstracts of Japan, vol. 16, No. 2 (M–1197), Jan. 07, 1992.

Patent Abstracts of Japan, vol. 9, No. 77 (M–369), Apr. 06, 1985.

Patent Abstracts of Japan, vol. 18, No. 193 (M–1588), Apr. 05, 1994.

*Primary Examiner*—Boris Milef

*Attorney, Agent, or Firm*—Fitzpatrick, Cella, Harper & Scinto

[57] ABSTRACT

The present invention provides a sheet conveying apparatus including a supporting unit for supporting a convey unit conveying a sheet for draw-out movement in a direction intersecting with a sheet conveying direction. The sheet conveying apparatus also includes a guide unit disposed upstream or a downstream of the convey unit to guide the sheet drawn out together with the draw-out convey unit so as not to be caught by any part of the apparatus.

15 Claims, 7 Drawing Sheets

SHEET CONVEYING APPARATUS HAVING A GUIDE UNIT FOR GUIDING A SHEET WHEN DRAWING OUT A CONVEY UNIT

BACKGROUND OF THE INVENTION

1. Field of the Invention

The present invention relates to a sheet conveying apparatus used with an image forming apparatus such as an electrostatic copying machine, printer, facsimile and the like.

2. Related Background Art

In a conventional image forming apparatus as shown in FIG. 6, there is provided a both-face image forming function or a multi image forming function in which a sheet on which an image was formed in an image forming portion is conveyed again to the image forming portion, where an image is formed on the other surface of the sheet or on the same surface.

In a both-face copy mode or a multi copy mode, the sheet on which the toner images were formed and fixed are temporarily stacked on an intermediate tray. Thereafter, the sheets are separated one by one, and the separated sheet is introduced into a regist introduction path 116 through a both-face convey path 115. The regist introduction path 116 serves to send the sheet to a regist rollers in which, after being temporarily stopped, the sheet is sent to the image forming portion in synchronism with the operation of the image forming portion. Thereafter, the toner image is formed on the sheet again in the image forming portion. Then, the image is fixed to the sheet, and then, the sheet is discharged out of the image forming apparatus.

With this arrangement, if the sheet P is jammed or trapped between the both-face convey path 115 and the regist introduction path 116, a tip end of the sheet is detected by a sheet detection means 157 disposed in the vicinity of an outlet of the both-face convey path 115 or/and a sheet detection means 158 disposed in the vicinity of an inlet of the regist introduction path 116, thereby displaying (for an operator) a removal direction of the jammed sheet on an operation display portion (not shown).

For example, if the tip end of the sheet P is detected by the sheet detection means 157 associated with the both-face convey path 115 but is not detected by the sheet detection means 158 associated with the regist introduction path 116, on the basis of information displayed on the operation display portion, the both-face convey path 115 supported by a guide rail 118 for shifting movement in a horizontal direction perpendicular to a sheet conveying direction can be shifted or retracted, by the operator, toward a front side of the image forming apparatus along the guide rail 118. On the other hand, if the tip end is also detected by the sheet detection means 158 associated with the regist introduction path 116, on the basis of information displayed on the operation display portion, the operator can remove the jammed sheet from a right side of the image forming apparatus by opening a convey portion opening means (not shown) disposed at a right side of the regist introduction path 116.

However, in the above-mentioned conventional apparatuses, if the tip end of the sheet P is detected by the sheet detection means 157 associated with the both-face convey path 115 but is not detected by the sheet detection means 158 associated with the regist introduction path 116, when the both-face convey path 115 is retracted toward the front side of the apparatus, since a trail end of the sheet is pinched between convey rollers 154 and the like, the sheet itself will be retracted together with the both-face convey guide 115. As a result, if the tip end of the sheet is entered into a pre-introduction path 116A in front of the sheet detection means 158, the tip end of the sheet will be caught by a frame 102A for supporting the regist introduction path 116, thereby causing damage (folding or tearing) of the sheet. As a result, the jam treatment becomes more difficult.

As the case may be, a torn portion of the sheet P remains in the convey path. Under such a condition, if the copying operation is re-started, the sheet jam may occur again.

Further, in the above mentioned conventional apparatuses, it was devised that, by partially removing the frame 102A for supporting the regist introduction path 116, the tip end of the sheet P is prevented from being caught by the frame. In this case, however, the rigidity of the frame is decreased, thereby increasing vibration and noise of the apparatus and worsening the appearance of the apparatus.

SUMMARY OF THE INVENTION

An object of the present invention is to provide a sheet conveying apparatus in which a jammed sheet can be removed easily and positively.

To achieve the above object, according to the present invention, there is provided a sheet conveying apparatus comprising convey means for conveying a sheet, a supporting means for supporting the convey means for draw-out movement in a direction intersecting with a sheet conveying direction, and a guide means disposed upstream or a downstream side of the convey means to guide the sheet drawn out (retracted) together with the retracted convey means in such a manner that the sheet is not caught by any part of the image forming apparatus.

DETAILED DESCRIPTION OF THE PREFERRED EMBODIMENTS

The present invention will now be explained with reference to the accompanying drawings.

First Embodiment

Figure 5:
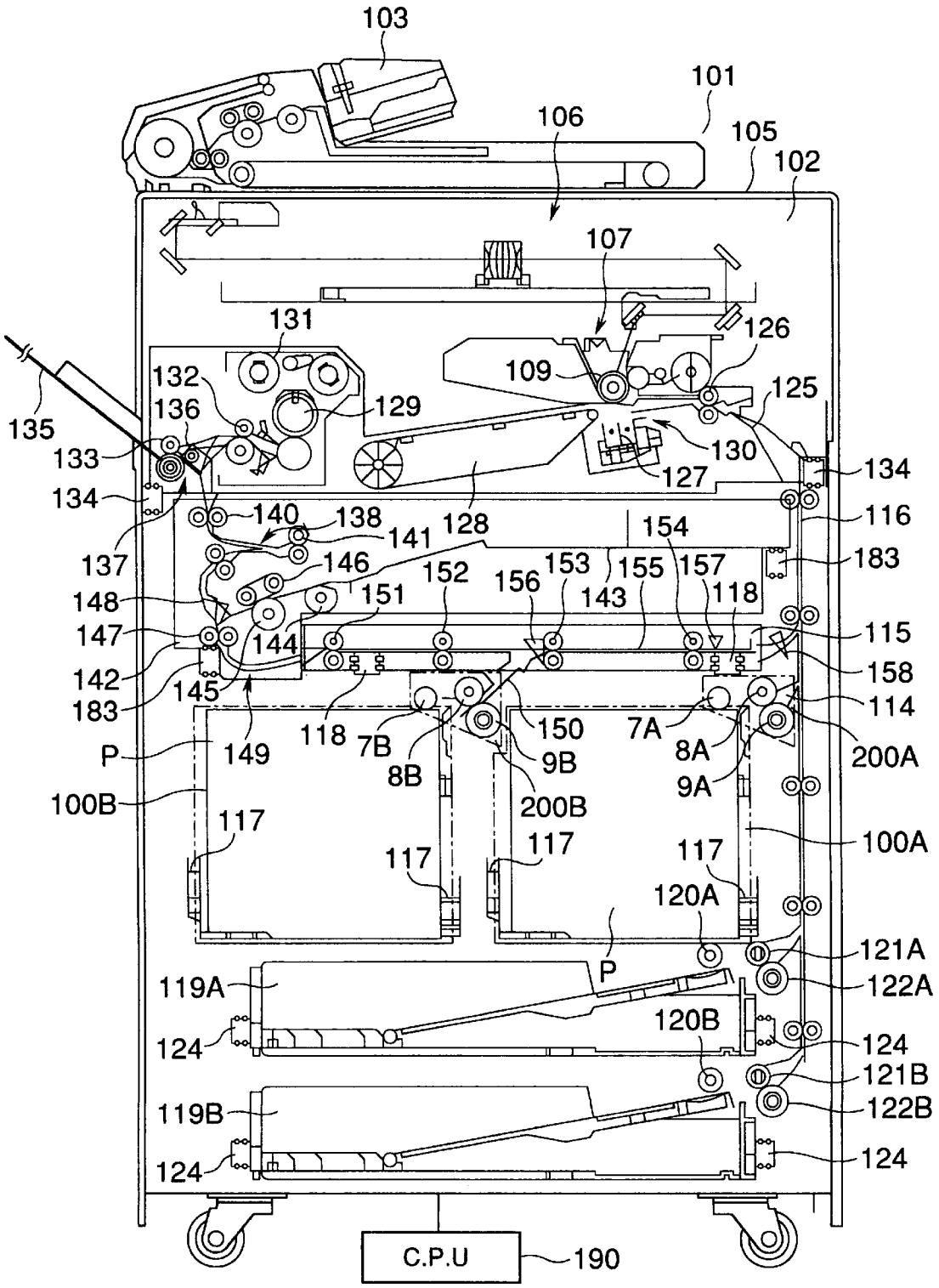
FIG. 5 is an elevational sectional view of an image forming apparatus having the sheet conveying apparatus according to the present invention.
Figure 6:
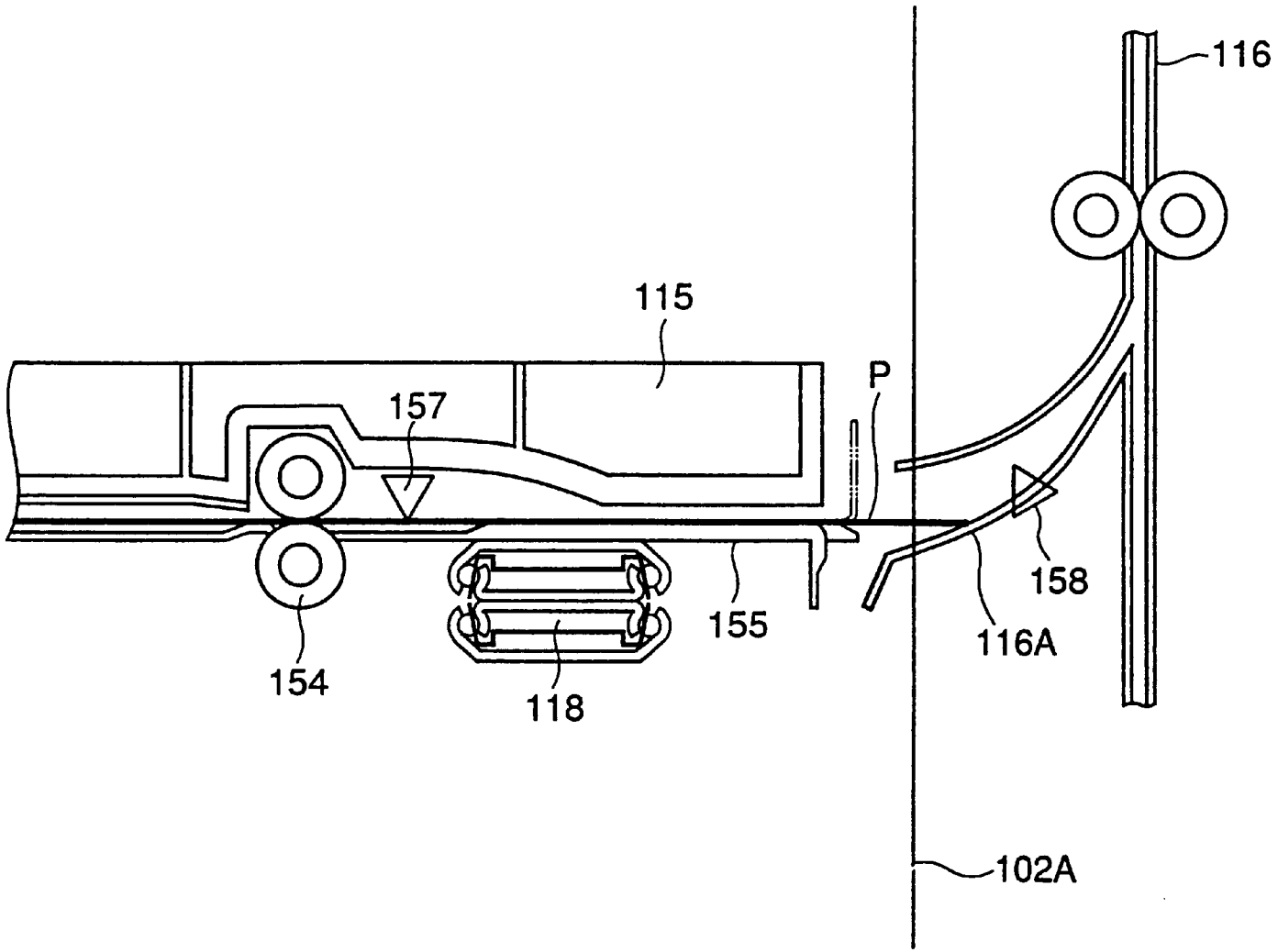
FIG.6 PRIOR ART
FIG. 6 is a partial sectional view showing an outlet of a convey path and an inlet of a regist introduction path of a conventional sheet conveying apparatus.

First of all, the entire construction of an image forming apparatus having a sheet conveying apparatus according to the present invention will be briefly described along a sheet conveying direction, with reference to FIG. 5 showing the image forming apparatus as an elevational sectional view.

In FIG. 5, an original (not shown) is automatically supplied from an automatic original supplying apparatus 103 onto a platen glass 105 disposed on a body 102 of the image forming apparatus (copying machine) 101. The original on the platen glass is scanned by an optical system 106, thereby forming a latent image on a photosensitive drum 109 disposed in an image forming portion 107. The latent image is developed to form a toner image on the photosensitive drum 109.

Within the body 102, there are provided sheet supply decks 100A, 100B each capable of containing a plurality of sheets P. The sheets P in the sheet supply decks 100A, 100B are supplied one by one by means of sheet supply portions 200A, 200B comprised of sheet supply rollers 7A, 7B, convey rollers 8A, 8B and separation rollers 9A, 9B, respectively. The sheet supplied from the sheet supply deck 100A is conveyed to a regist introduction path 116 through a right deck path 114. On the other hand, the sheet supplied from the sheet supply deck 100B is conveyed to the regist introduction path 116 through a left deck path 150 and a both-face convey path 115.

The sheet supply decks 100A, 100B are guided by deck guide rails 117 and can be retracted toward a front side of the image forming apparatus (front loading type). Further, the both-face convey guide 115 is guided in a substantially horizontal direction by both-face convey guide rails (retracting means) 118 to be slidably shifted in a direction perpendicular to a sheet conveying direction in the both-face convey path 115. In this way, during the sheet jam treatment, the both-face convey path 115 can be retracted toward the front side of the image forming apparatus.

Below the sheet supply decks 100A, 100B, there are disposed sheet supply cassettes 119A, 119B containing sheets therein. The sheets in the sheet supply cassettes 119A, 119B are supplied one by one by sheet supply rollers 120A, 120B, convey rollers 121A, 121B and separation rollers 122A, 122B, respectively. The sheet P supplied from the sheet supply cassette 119A or 119B is introduced into the regist introduction path 116. The sheet supply cassettes 119A, 119B are guided by cassette guide rails 124 and can be retracted toward the front side of the image forming apparatus (front loading type).

At a downstream side of the regist introduction path 116, there are disposed a pre-regist guide 125 for guiding the sheet P supplied from the regist introduction path 116 and a pair of regist rollers 126. The image forming station (107, 130) comprises an upper image forming portion 107 including the photosensitive drum 109, and a lower image forming portion 130 including a transfer/separation charger portion 127, a convey portion 128, a fixing portion 131 and a sheet discharge path 137. The lower image forming portion 130 is guided by guide rails 134 to be retracted toward the front side of the body 102 of the image forming apparatus.

The toner image formed on the photosensitive drum 109 is transferred onto the sheet P (sent from the pair of regist rollers 126) by the transfer/separation charger portion 127. Then, the sheet is sent, through the convey portion 128, to the fixing portion 131, where the toner image is permanently fixed to the sheet by means of a fixing roller 129. In a one-face copy mode (in which the image is formed on one surface of the sheet), a switching member 136 is positioned in a first position where, after the fixing, the sheet P conveyed by a pair of inner discharge rollers 132 is guided by a pair of outer discharge rollers 133. Thus, in this case, after the fixing, the sheet P is discharged onto a sheet discharge tray 135 by the sheet discharge path 137 including the pair of inner discharge rollers 132, the switching member 136 and the pair of outer discharge rollers 133.

A both-face unit 142 including an intermediate tray 143 is disposed below the image forming portion 130. The both-face unit 142 can be retracted toward the front side of the body 102 of the image forming apparatus while being guided by guide rails 183.

On the other hand, in a both-face copy mode (in which the images are formed on both surface of the sheet) or a multi copy mode (in which the images are formed on the same surface of the sheet in a superimposed fashion), the switching member 136 is positioned in a second position where, after the fixing, the sheet P conveyed by the pair of inner discharge rollers 132 is reversely rotated (turned up) and then is guided to a reverse rotation path 138. Thus, in this case, after the fixing, the sheet P is sent to the reverse rotation path 138 through the pair of inner discharge rollers 132 and the switching member 136 and then is discharge onto the intermediate tray 143 by pairs of convey rollers 140, 141. The sheets P temporarily stacked on the intermediate tray 143 are supplied (from lower side) by means of a sheet supply roller 144, and the supplied sheets are separated and supplied one by one by means of a convey roller 145 and a separation belt 146.

In the both-face copy mode, the sheet P re-supplied from the intermediate tray 143 is sent, by a switching member 148, to a sheet re-supply path 149 including a pair of convey rollers 147, from which the sheet is introduced into the both-face convey path 115. Then, the sheet P is conveyed by pairs of convey rollers 151, 152, 153, 154 while being guided by a guide 155 of the both-face convey path 115 and then is introduced into the regist introduction path 116 through a junction guide or pre-introduction path 116A (SEE FIG 1). Thereafter, the sheet is sent to the image forming portion 130, where the image is formed on the other surface of the sheet. After the image formation, the sheet is discharged onto the discharge tray 135. A convey means or first convey means according to the present invention is constituted by the guide 155 of the both-face convey path 115, and the pairs of convey rollers 151, 152, 153, 154. A second convey means according to the present invention is constituted by the pre-introduction path (junction guide) 116A of the regist introduction path 116, regist introduction path portions 116B, 116C (FIG. 1A) and a pair of convey rollers 116D for pinching and conveying the sheet.

Next, the sheet jam treatment will be explained.

Figure 1A:
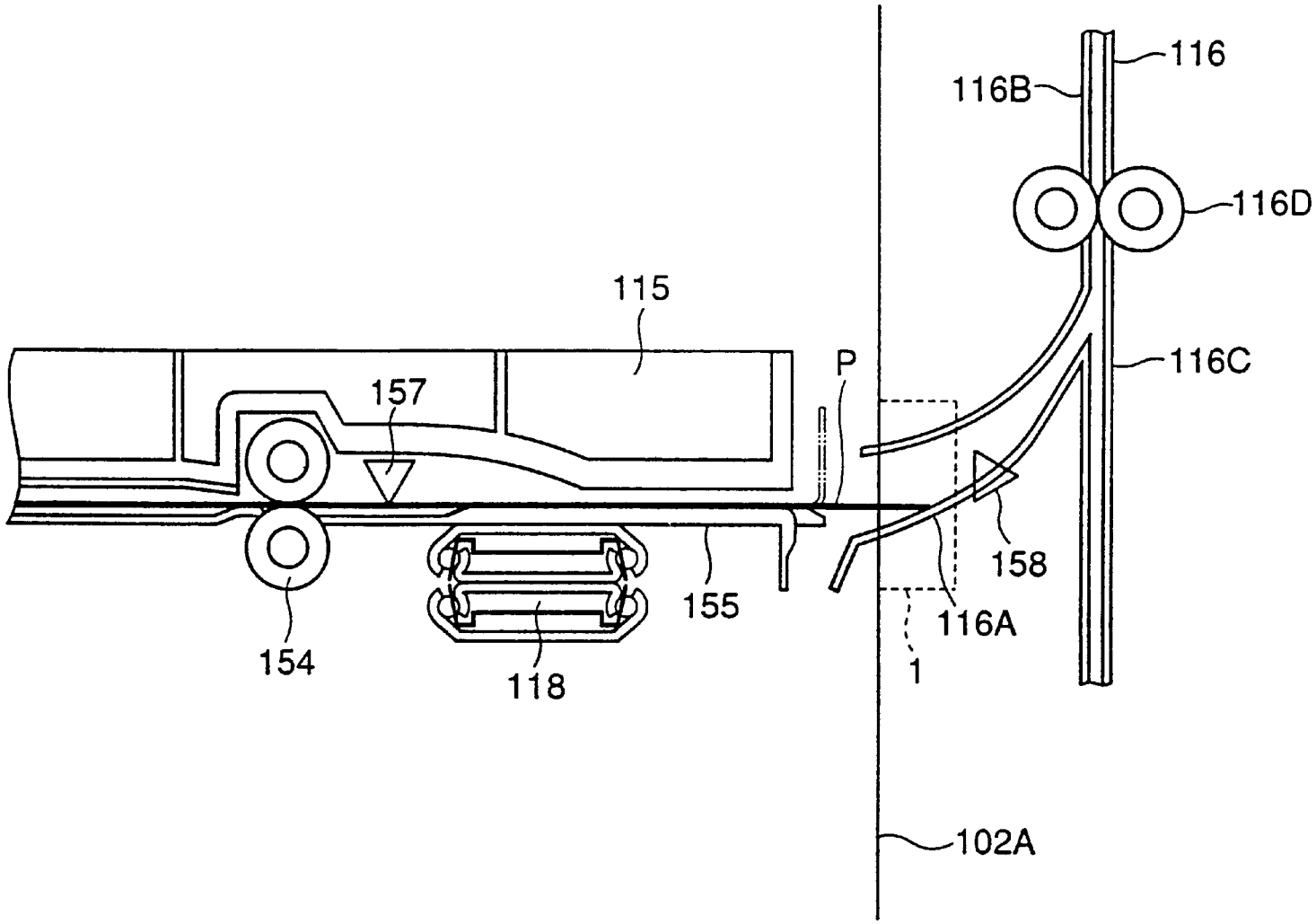
FIG. 1(A) is a partial sectional view showing an outlet of a both-face convey path and an inlet of a regist introduction path of a sheet conveying apparatus according to the present invention.

FIG. 1(A) is a sectional view showing the both-face convey path 115 and the regist introduction path 116 and further showing a condition that the sheet P is jammed or trapped.

In FIG. 1(A), the both-face convey path 115 includes the pairs of convey rollers 151, 152, 153, 154 and the both-face guide 155 as mentioned above. A sheet detection means 156 (FIG. 5) is disposed immediately at an upstream side of the pair of convey rollers 153 and a sheet detection means 157 is disposed immediately at a downstream side of the pair of convey rollers 154. Further, a sheet detection means 158 is disposed in the vicinity of an inlet of the regist introduction path 116. The jammed sheet P is positioned in such a manner that a tip end of the sheet has passed through the sheet detection means 157 disposed immediately at the downstream side of the pair of convey rollers 154 but does not reach the detection means 158 disposed in the vicinity of the inlet of the regist introduction path 116.

In this condition, the image forming operation of the image forming apparatus 101 (FIG. 5) is stopped by a control means (not shown), and the command that the both-face convey path 115 should be retracted toward the front side of the body 102 of the apparatus to remove the jammed sheet P is displayed on the operation display portion. In accordance with this command, when the operator retracts the both-face convey path 115 toward the front side of the apparatus body 102, the sheet P pinched between the pair of convey rollers 154 and the like is also retracted toward the front side with the tip end thereof protruded from the end of the both face convey path 115. A frame 102A of the apparatus body 102 serves to support the guide rail 118 for slidably supporting the both-face convey path 115 or for supporting the regist introduction path 116.

Figure 2:
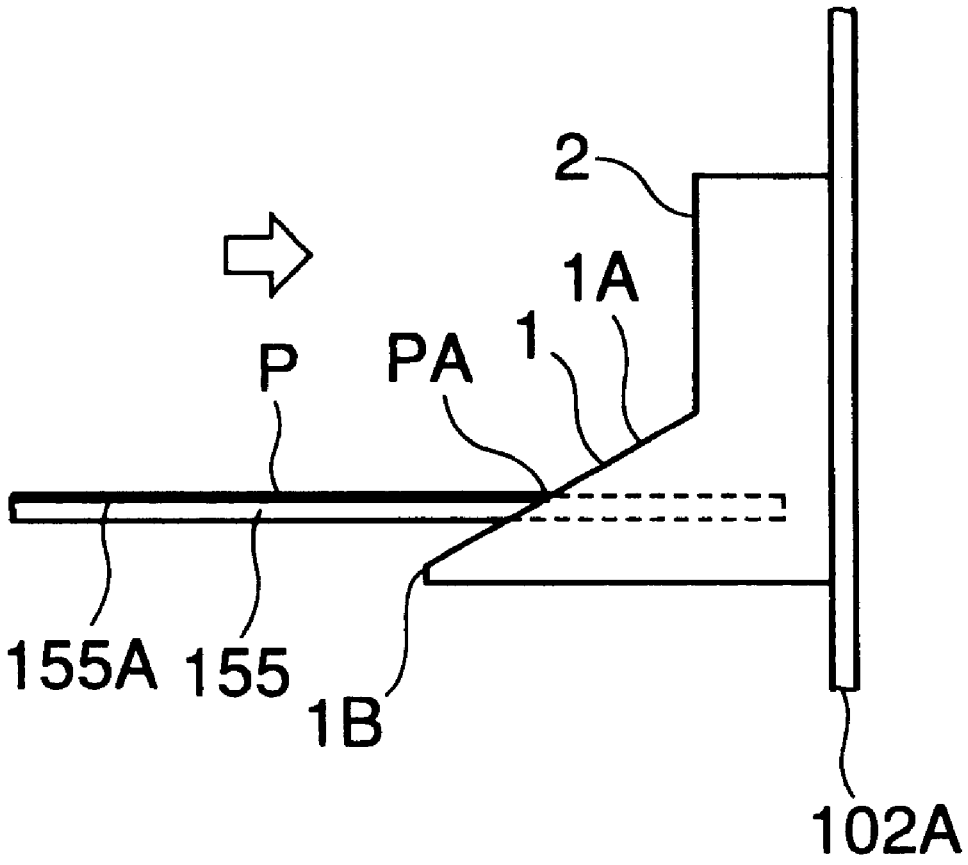
FIG. 2 is a side view showing a condition that a sheet is contacted with a first sheet guide means of the sheet conveying apparatus.

A lateral end portion PA of the retracted sheet P is shifted in a direction shown by the arrow in FIG. 2. Thus, the lateral end portion PA of the sheet P is gradually lifted while sliding contacting with an inclined guide surface 1A of a first sheet guide means 1 disposed inside of the frame 102A of the apparatus body 102 until the sheet abuts against a second vertical sheet guide means 2 contiguous with the first sheet guide means 1.

By the way, since a lower end 1B (in the vicinity of a width of the sheet convey path) of the inclined guide surface 1A of the first sheet guide means 1 is positioned sufficiently below a guide surface 155A of the both-face convey guide 155 for regulating or defining a sheet conveying level and a terminal end 1C of the inclined guide surface 1A extending in the retracting direction of the both-face convey path 115 is positioned above the sheet conveying level, the lateral end portion of the sheet P is dipped by the inclined guide surface 1A without striking against the first sheet guide means 1.

Figure 3:
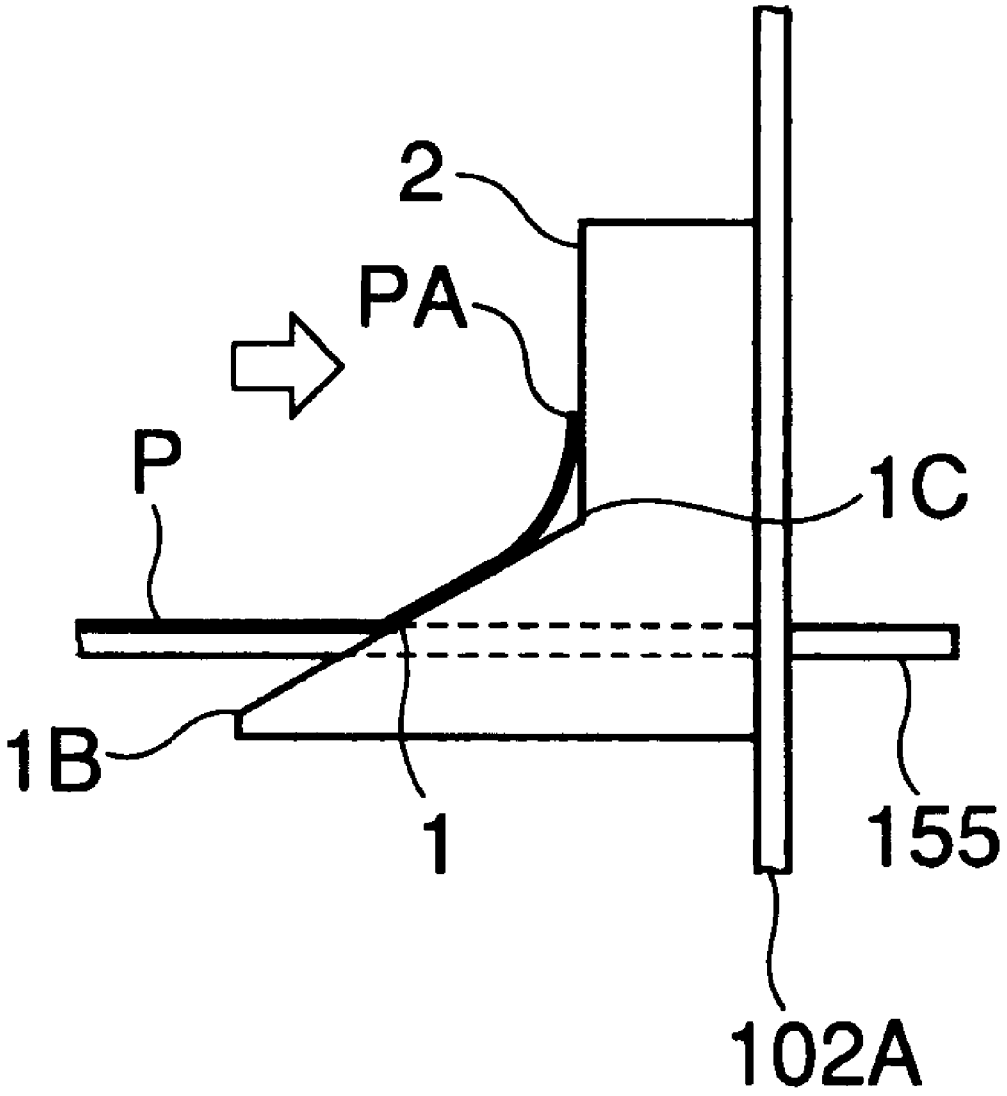
FIG. 3 is a side view showing a condition that the sheet is contacted with a second sheet guide means of the sheet conveying apparatus.
Figure 4:
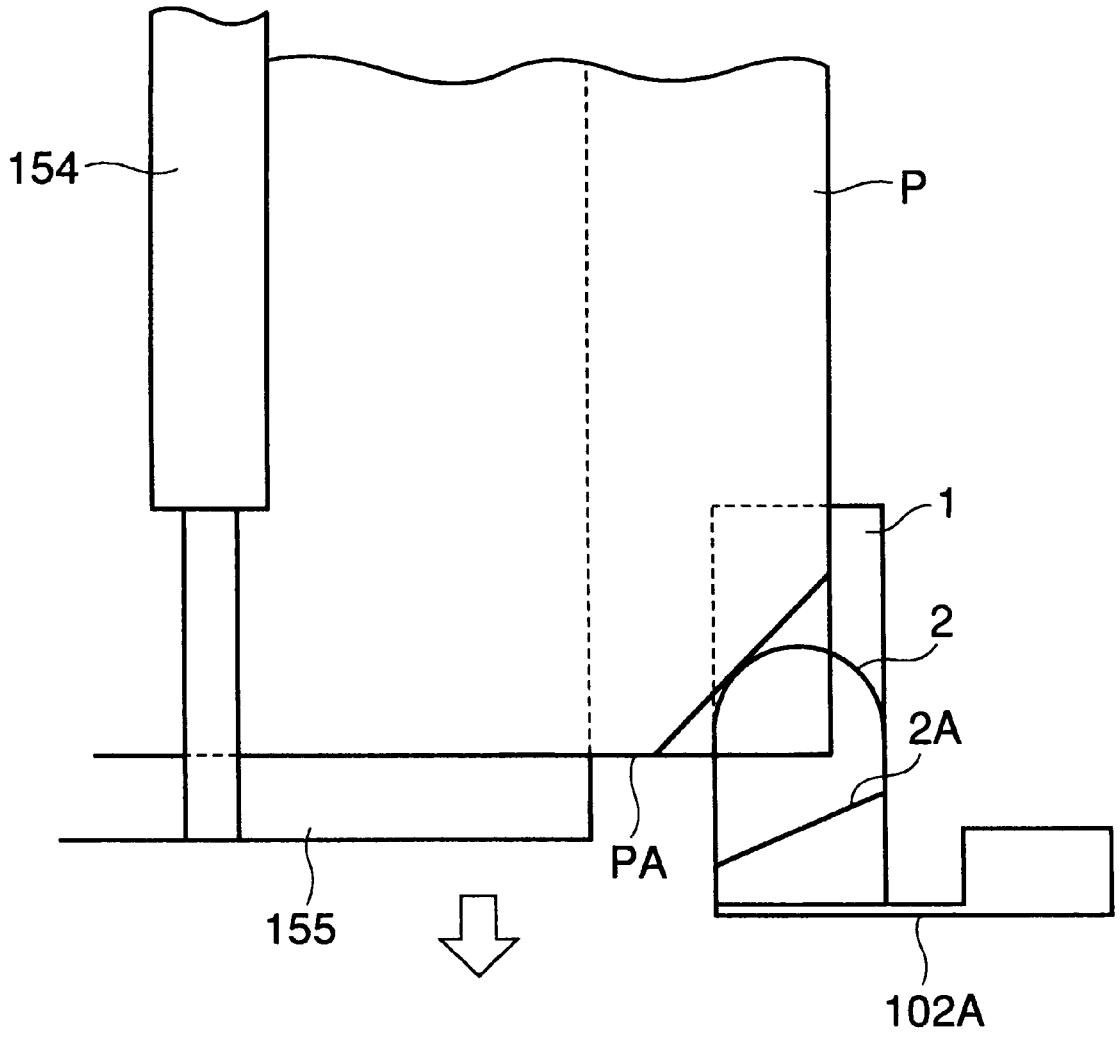
FIG. 4 is a plan view showing a condition that the sheet is contacted with the second sheet guide means of the sheet conveying apparatus.

Then, the lateral end portion of the sheet abutting against the second sheet guide means 2 is gradually lifted along the second vertical sheet guide means 2 as shown in FIG. 3 so that the corner of the sheet P is lifted in a triangular shape. That is to say, in order to prevent the sheet from being caught by the second sheet guide means 2, the second sheet guide means 2 has, for example, a semi-circular section looked at from the above as shown in FIG. 4 so that the second sheet guide means is not parallel to the lateral end portion of the sheet P.

The corner of the sheet lifted in the triangular shape is gradually cocked (as shown by the phantom line in FIG. 1A) while sliding on the semi-circular guide surface of the second sheet guide means as the both-face convey path 115 is retracted. Thus, since the lateral end portion of the sheet is retracted together with the both-face convey path 115 through a clearance between the both-face convey path and the frame 102A, the jammed sheet P can easily be removed.

The first and second sheet guide means constitute a guide means for guiding the sheet without being caught by the frame 102A or a bending means for bending the sheet without being caught by the frame 102A. The sheet may bend upwardly or downwardly. Further, the retracting direction of the convey means is not limited to the substantially horizontal direction. In addition, the retracting direction of the convey means is not limited to the direction perpendicular to the sheet conveying direction. However, when the retracting direction of the convey means is parallel with the surface of the sheet being conveyed by the convey means, the excellent advantage can be obtained. That is to say, when the present invention is not adapted, if the protruded portion of the sheet retracted substantially in parallel with the surface of the sheet interferes with any part of the apparatus, the sheet is greatly damaged.

Second Embodiment

In the above-mentioned first embodiment, while an example that the first and second sheet guide means 1, 2 are integrally formed with each other and are secured to the frame 102A was explained, as a second embodiment of the present invention, a first sheet guide means may be separated from a second sheet guide means. For example, a part of a lower guide 106A disposed in the vicinity of the inlet of the regist introduction path 106 is extended in the retracting direction of the sheet P to form an extension which constitutes the first sheet guide means, and a part of the frame 102A opposed to the first sheet guide means is formed as a semi-circular shape which constitutes the second sheet guide means. Also in this case, the same advantage as the first embodiment can be achieved.

Third Embodiment

In the above-mentioned first and second embodiments, while an example that the second sheet guide means has the semi-circular shape was explained, since the fact that the section of the second sheet guide means looked at from the above is not parallel with the lateral end portion of the sheet P may be satisfied, for example, as shown by the phantom line 2A in FIG. 4, the second sheet guide means can have an inclined edge having a left lower end and a right upper end. Also in this case, the same advantage as the first embodiment can be achieved.

Incidentally, in the above-mentioned first to third embodiments, while an example that the present invention is applied to the proximity of the both-face convey path was explained, the present invention is not limited to such an example. The present invention can be applied to any pair of movable and fixed parts in the sheet conveying path, for example, between the sheet supply portions 200 and the apparatus body 102, between the sheet supply decks 100 and the apparatus body, between the cassettes 119 and the apparatus body and/or between the image forming portion and the apparatus body.

In the above-mentioned embodiments, with the arrangements as mentioned above, if the sheet is jammed between the both-face convey path 115 and the regist introduction path 116 in a condition that the tip end of the sheet P is not detected by the sheet detection means 158 associated with the regist introduction path 116, when the both-face convey path 115 is retracted toward the front side of the apparatus body, the end portion of the jammed sheet P protruded in the regist introduction path 116 (i.e., protruded from the downstream end of the both-face convey path 115) is not caught by the frame 102A of the body 102 supporting the regist introduction path 116, and, thus, the jammed sheet can be removed positively and quickly, thereby facilitating the sheet jam treatment.

Further, since a portion of the frame 102A of the apparatus body 102 supporting the regist introduction path 116 is not required to be removed or cut out to prevent the protruded portion of the sheet from being caught by the frame, the rigidity of the frame is not decreased, thereby preventing the vibration and noise of the image forming apparatus and increasing the degree of freedom for designing the appearance of the apparatus.

Incidentally, in the above-mentioned embodiments, while an example that the first and second sheet guide means are provided on the frame between the both-face convey path 115 and the downstream regist introduction path 116 was explained, the present invention is not limited to such an example. For example, the first and second sheet guide means may be provided on a frame disposed between the both-face convey path 115 and the upstream sheet re-supply path 149.

Figure 1B:
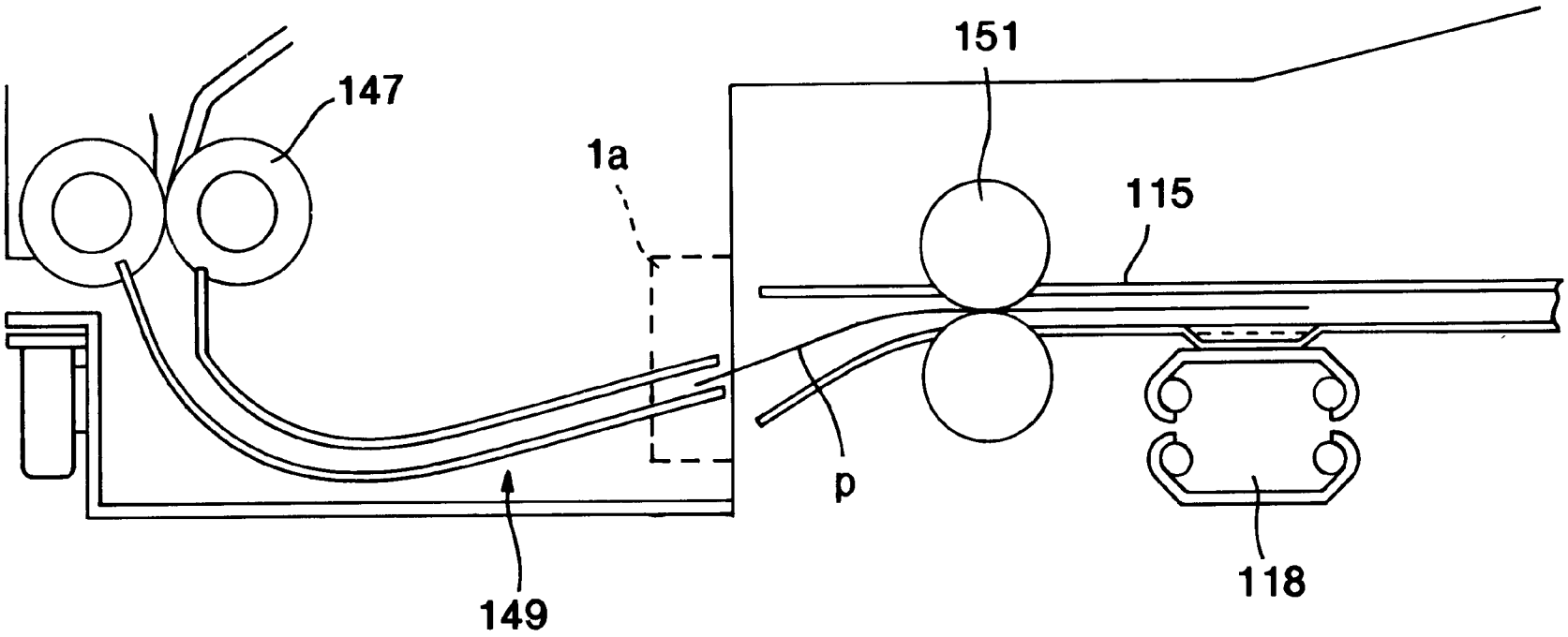
FIG. 1(B) is a partial sectional view of a guide means disposed upstream of a convey path.

Specifically, as shown in FIG. 1(B), the first and second sheet guide means may be disposed upstream of both-face convey path 115.

When the both-face convey path 115 is retracted from the image forming apparatus having many parts disposed in a compact fashion, the inlet and outlet of the both-face convey path 115 are shifted in the vicinity of the frame or other parts. In summary, according to the present invention, in such a case, even if the sheet is protruded from the inlet or the outlet, the protruded portion of the sheet is bent by the guide means so that the sheet is not contacted with (or does not interfere with) the frame or any other part of the image forming apparatus, or, the protruded portion of the sheet is guided while slidingly contacting with the guide means so that the sheet is not caught by any part of the apparatus. The guide means can prevent not only the interference between the sheet and the frame but also the interference between the sheet and any part of the apparatus.

As mentioned above, according to the present invention, there is provided a sheet conveying apparatus in which a jammed sheet can be removed easily and positively.

What is claimed is:

1. A sheet conveying apparatus comprising:

first convey means for pinching and conveying a sheet;

draw-out means for supporting said first convey means and capable of drawing out said first convey means in a draw-out direction, which is perpendicular to a sheet conveying direction;

second convey means disposed downstream of said first convey means in the sheet conveying direction to pinch and convey the sheet;

a frame for supporting said second convey means for conveying the sheet; and first guide means, and second guide means continuously formed with said first guide means, for guiding the sheets said first guide means and said second guide means being disposed in a downstream direction from said first convey means on a side of said frame, said first guide means and said second guide means extending in the draw-out direction of said draw-out means for bending and guiding the sheet when said draw-out means is drawing out said first convey means, thereby preventing interference of the sheet with said frame.

2. A sheet conveying apparatus according to claim 1, wherein a first end of said first sheet guide means is positioned below a sheet conveying level of said first convey means and a second end is positioned above said sheet conveying level.

3. A sheet conveying apparatus according to claim 1, wherein said second sheet guide means extends from a second end of said first guide means substantially in the vertical direction and perpendicularly abuts against a lateral end portion of the sheet drawn out together with said first convey means, and said second sheet guide means has a section that is non-parallel with the lateral end portion of the sheet.

4. A sheet conveying apparatus comprising:

first convey means for pinching and conveying a sheet;

draw-out means for supporting said first convey means and capable of drawing out said first convey means in a draw-out direction, which is perpendicular to a sheet conveying direction;

second convey means disposed downstream of said first convey means in the sheet conveying direction to pinch and convey the sheet;

a frame for supporting said second convey means; and first guide means, and second guide means continuously formed with said first guide means, for guiding the sheet, said first guide means and said second guide means being disposed in a downstream direction from said first convey means on a side of said frame, said first guide means and said second guide means extending in the draw-out direction of said draw-out means for bending and guiding the sheet when said draw-out means is drawing out said first convey means, thereby preventing interference of the sheet with said frame, wherein said first guide means is disposed to have a first end at a different level relative to a sheet convey height of said first convey means, and said second guide means extending from a second end of said first guide means extended substantially in a vertical direction.

5. A sheet conveying apparatus according to claim 4, wherein said first end of said first sheet guide means is positioned below said sheet conveying height of said first convey means and said second end is positioned above said sheet conveying height.

6. A sheet conveying apparatus according to claim 4, wherein said second sheet guide means perpendicularly abuts against a lateral end portion of the sheet drawn out together with said first convey means, and said second sheet guide means has a section not to be in parallel with the lateral end portion of the sheet.

7. A sheet conveying apparatus comprising:

convey means for conveying a sheet;

supporting means for supporting said convey means for draw-cut movement in a draw-out direction intersecting with a sheet conveying direction; and guide means disposed upstream or downstream of said convey means to bend and guide the sheet drawn out together with the drawn out convey means so as to prevent the sheet from being caught by any part of the apparatus.

8. A sheet conveying apparatus according to claim 7, wherein said guide means is disposed upstream or downstream of said convey means to guide a protruded portion of the sheet drawn out together with said convey means and protruded from said convey means, in the upstream direction or the downstream direction, respectively.

9. A sheet conveying apparatus according to claim 7, wherein said convey means has rotatable rollers for pinching the sheet.

10. A sheet conveying apparatus according to claim 7, wherein said convey means includes a guide for guiding the sheet.

11. A sheet conveying apparatus according to claim 7, wherein said supporting means serves to support said convey means to be drawn out in a direction substantially parallel with a surface of the sheet to be conveyed.

12. A sheet conveying apparatus according to claim 7, wherein said guide means serves to guide the sheet drawn out together with said convey means so as to pass a position such that the sheet is prevented from contacting any other part of the apparatus.

13. A sheet conveying apparatus according to claim 7, further comprising an image forming means for forming an image on the sheet conveyed by said convey means.

14. A sheet conveying apparatus according to claim 13, wherein said convey means is a component of a sheet re-supply means for resending the sheet on which the image was formed by said image forming means to said image forming means.

15. A sheet conveying apparatus comprising:

convey means for conveying a sheet along a sheet conveying path in a sheet conveying direction;

supporting means for supporting said convey means during a draw-out movement of said convey means out of the sheet conveying apparatus in a direction intersecting with the sheet conveying direction; and guide means disposed upstream or downstream of said convey means near said sheet conveying path, wherein said guide means extends from near said sheet conveying path in a draw-out direction, and bends and guides the sheet during the draw-out movement of said convey means so as to prevent the sheet from being caught by any fixed part of the sheet conveying apparatus.

* * * * *

UNITED STATES PATENT AND TRADEMARK OFFICE

CERTIFICATE OF CORRECTION

PATENT NO. : 5,908,190

DATED : June 1, 1999

INVENTOR(S) : MAKOTO TANAKA

It is certified that error appears in the above-identified patent and that said Letters Patent is hereby corrected as shown below:

COVER PAGE AT ITEM [54] TITLE,
"DRAWING OUT" should read --DRAWING-OUT--.

COVER PAGE AT ITEM [57] ABSTRACT,
Line 6, "or a" should read --or--.

COLUMN 1,
Line 3, "DRAWING OUT" should read --DRAWING-OUT--; and
Line 26, "a" should be deleted.

COLUMN 4,
Line 11, "surface" should read --surfaces--;
Line 20, "discharge" should read --discharged--; and
Line 35, "(SEE" should read --(See--.

Column
Line 40, "from the" should read --from--.

COLUMN 7,
Line 40, "sheets" should read --sheet,--.

UNITED STATES PATENT AND TRADEMARK OFFICE

CERTIFICATE OF CORRECTION

PATENT NO. : 5,908,190

DATED : June 1, 1999

INVENTOR(S) : MAKOTO TANAKA

It is certified that error appears in the above-identified patent and that said Letters Patent is hereby corrected as shown below:

COLUMN 8,
Line 29, "in" should be deleted; and
Line 34, "draw-cut" should read --draw-out--.

Signed and Sealed this

Twenty-first Day of March, 2000

*Attest:*

*Attesting Officer*

Q. TODD DICKINSON

*Commissioner of Patents and Trademarks*